US009183780B2

(12) United States Patent
Kim et al.

(10) Patent No.: US 9,183,780 B2
(45) Date of Patent: Nov. 10, 2015

(54) ORGANIC LIGHT EMITTING DISPLAY

(71) Applicant: LG DISPLAY CO., LTD., Seoul (KR)

(72) Inventors: Seungtae Kim, Goyang-si (KR); Byungchul Ahn, Seoul (KR); Joonyoung Kim, Paju-si (KR); Joongsun Yoon, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 91 days.

(21) Appl. No.: 13/939,956

(22) Filed: Jul. 11, 2013

(65) Prior Publication Data

US 2014/0168184 A1 Jun. 19, 2014

(30) Foreign Application Priority Data

Dec. 13, 2012 (KR) ..... 10-2012-0145352
May 28, 2013 (KR) ..... 10-2013-0060547

(51) Int. Cl.
*G09G 3/30* (2006.01)
*G09G 3/32* (2006.01)

(52) U.S. Cl.
CPC ..... *G09G 3/3258* (2013.01); *G09G 3/3233* (2013.01); *G09G 2310/0251* (2013.01); *G09G 2310/0254* (2013.01); *G09G 2310/067* (2013.01); *G09G 2320/043* (2013.01); *G09G 2320/048* (2013.01); *G09G 2330/027* (2013.01); *G09G 2360/16* (2013.01)

(58) Field of Classification Search
None
See application file for complete search history.

(56) References Cited

U.S. PATENT DOCUMENTS

| | | | | |
|---|---|---|---|---|
| 2005/0057459 | A1 | 3/2005 | Miyazawa | |
| 2006/0066252 | A1 | 3/2006 | Kim | |
| 2006/0187154 | A1* | 8/2006 | Tsuchida | 345/76 |
| 2008/0094320 | A1 | 4/2008 | Parikh et al. | |
| 2009/0167644 | A1 | 7/2009 | White et al. | |
| 2009/0207105 | A1 | 8/2009 | Hwang et al. | |
| 2009/0213046 | A1 | 8/2009 | Nam | |
| 2009/0262101 | A1* | 10/2009 | Nathan et al. | 345/211 |
| 2011/0122119 | A1 | 5/2011 | Bae et al. | |
| 2012/0050274 | A1 | 3/2012 | Yoo et al. | |

OTHER PUBLICATIONS

Extended European Search Report issued in corresponding European Patent Application No. 13180252.2, mailed Jan. 21, 2014, 8 pages.

* cited by examiner

*Primary Examiner* — Joseph Haley
*Assistant Examiner* — Ifedayo Iluyomade
(74) *Attorney, Agent, or Firm* — Brinks Gilson & Lione

(57) ABSTRACT

An organic light emitting display includes a display panel including data lines, gate lines crossing the data lines, and pixels and a panel driving circuit which supplies a data voltage to the pixels of the display panel during a power-on period and then is additionally driven for a predetermined power-on delay duration time delayed from a power-off start time of a power input signal. The panel driving circuit supplies a reverse polarity recovery voltage having a polarity opposite the data voltage to the pixels or supplies a recovery voltage, which is different from a gate voltage of a driving element of each of the pixels, to a source terminal of the driving element of each pixel for the predetermined power-on delay duration time.

18 Claims, 16 Drawing Sheets

ORGANIC LIGHT EMITTING DISPLAY

This application claims priority to Korean Patent Application No. 10-2012-0145352, filed on Dec. 13, 2012 and Korean Patent Application 10-2013-0060547 filed on May 28, 2013, the entirety of which is hereby incorporated by reference herein.

BACKGROUND OF THE INVENTION

1. Field of the Invention

Embodiments of the invention relate to an organic light emitting display supplying a reverse polarity voltage for recovering reliability of pixels to the pixels after power of the organic light emitting display is turned off.

2. Discussion of the Related Art

Each pixel of an organic light emitting display includes an organic light emitting diode (OLED) having a self-emitting structure. The OLED is configured through the stack of organic compound layers including a hole injection layer, a hole transport layer, an emission layer, an electron transport layer, an electron injection layer, etc. The OLED emits light when electrons and holes are combined in an organic layer through a current flowing in a fluorescence or phosphorescence organic thin film.

Each of pixels of an active matrix organic light emitting display includes a driving element and a switching element. The driving element and the switching element are thin film transistors (TFTs) having a metal oxide semiconductor field effect transistor (MOSFET) structure and are formed on a substrate of a display panel. When a reverse bias is applied to the OLED, the OLED does not emit light because the OLED has a polarity. The driving element controls a current flowing in the OLED based on data of an input image. A data voltage of the same polarity is repeatedly supplied to a gate of the driving element in a normal drive mode. However, when the data voltage of the same polarity is repeatedly supplied to the gate of the driving element, a threshold voltage of the driving element is shifted because of a gate bias stress of the driving element resulting from characteristics of the MOSFET structure. Also, the driving element is degraded, and thus reliability of the pixels is reduced. The gate bias stress degrades the driving element and thus reduces life span of the organic light emitting display.

SUMMARY OF THE INVENTION

Embodiments of the invention provide an organic light emitting display capable of recovering characteristics of a driving element of each pixel.

In one aspect, there is an organic light emitting display comprising a display panel including data lines, gate lines crossing the data lines, and pixels and a panel driving circuit which supplies a data voltage to the pixels of the display panel during a power-on period and then is additionally driven for a predetermined power-on delay duration delayed time from a power-off start time of a power input signal.

The panel driving circuit supplies a reverse polarity recovery voltage having a polarity opposite the data voltage to the pixels or supplies a recovery voltage, which is different from a gate voltage of a driving element of each of the pixels, to a source terminal of the driving element of each pixel for the predetermined power-on delay duration time.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

The present invention as described herein may be embodied in a number of different forms. Not all of the depicted components may be required, however, and some implementations may include additional, different, or fewer components from those expressly described in this disclosure. Variations in the arrangement and type of the components may be made without departing from the spirit or scope of the claims as set forth herein.

An organic light emitting display according to an exemplary embodiment of the invention additionally drives a panel driving circuit for a predetermined power-on delay duration time after power to the organic light emitting display is turned off. The organic light emitting display may also supply a reverse polarity recovery voltage to pixels, or apply a high voltage to a source terminal of a driving element of each pixel, during the predetermined power-on delay duration time, thereby improving reliability of the pixels. The reverse polarity recovery voltage may have a polarity opposite a data voltage of an input image. In this way, the organic light emitting display of the present invention operates such that a panel driving circuit is not automatically disabled when power to the organic light emitting display is turned off. This is in contrast to other organic light emitting displays where a panel driving circuit is disabled so that it stops working when power to such other light emitting displays is turned off.

Figure 1:
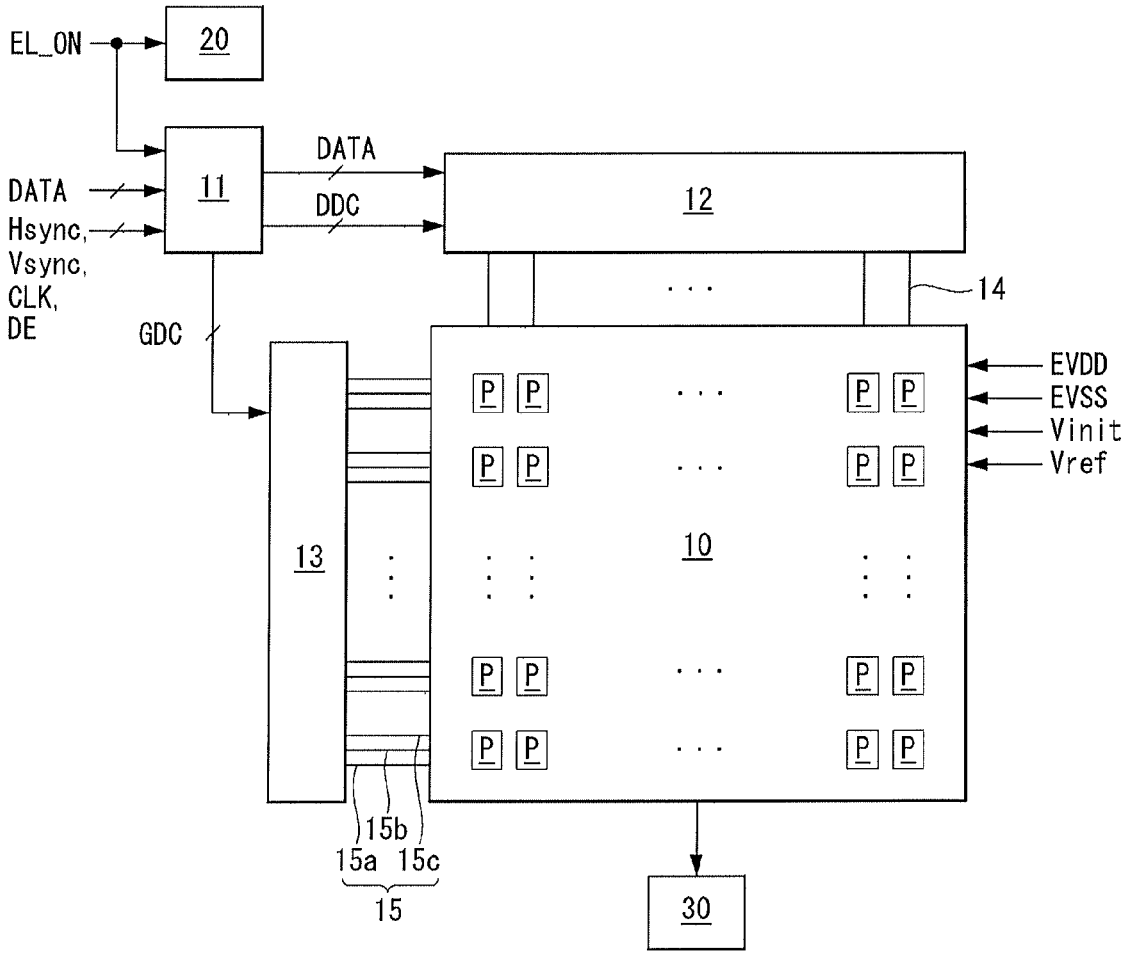
FIG. 1 is a block diagram of an organic light emitting display according to an example embodiment of the invention.

As shown in FIG. 1, the organic light emitting display according to the present invention may include a display panel 10, a panel driving circuit for writing data to the display panel 10, and a power supply unit 20 generating electric power required to drive the display panel 10 and the panel driving circuit.

Figure 7:
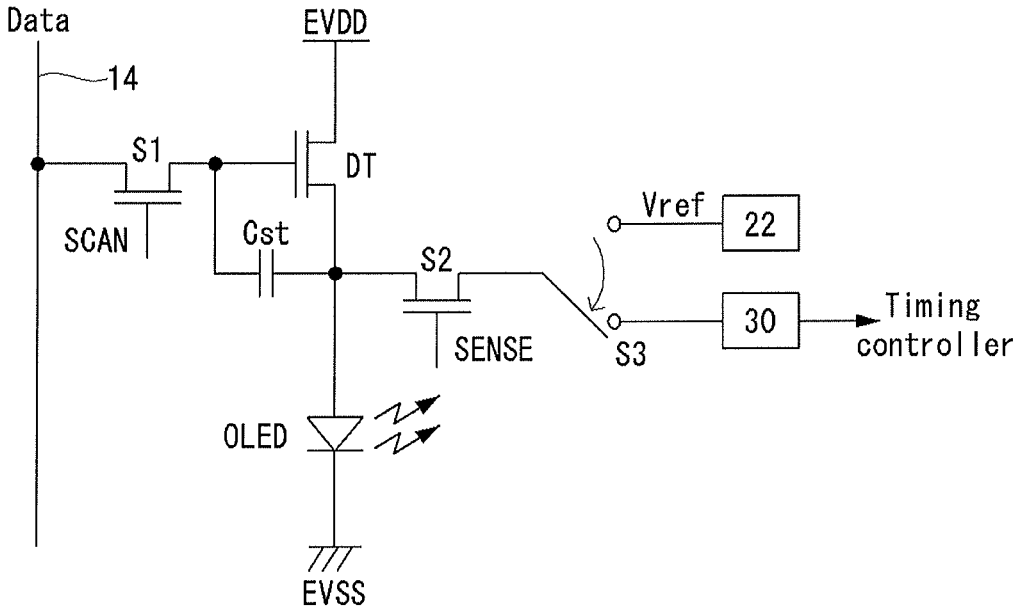
FIG. 7 illustrates a method for sensing characteristics of a driving element of each pixel.

The panel driving circuit may include a sensing unit 30, a data driving circuit 12, a gate driving circuit 13, and a timing controller 11. The panel driving circuit further may further include a reference voltage generator 22, as illustrated in FIG. 7. The panel driving circuit may sense a change in a power input signal EL_ON such that the panel driving circuit is able to determine a time at which the power to the organic light emitting display is turned off.

The power input signal EL_ON rises to a high logic level '3.3V' in a power-on state when power to the organic light emitting display is turned on. The power input signal EL_ON is held at the high logic level '3.3V' until power to the organic light emitting display is turned off, corresponding to a power-off state. When the power of the organic light emitting display is turned off, either by a user or other similar controlling means, the organic light emitting display is converted to a power-off state. In the power-off state, driving voltages of the organic light emitting display may be sequentially turned off based on a previously determined power-off sequence. The power input signal EL_ON falls to a low logic level '0V' when the organic light emitting display is converted to the power-off state. Thus in this way, the power input signal EL_ON may indicate whether power to the organic light emitting display is turned on or off.

The panel driving circuit receives logic power for a power-on delay duration time and is additionally driven. The panel driving circuit supplies a reverse polarity recovery voltage to a gate of a driving element formed in each pixel of the organic light emitting display, or applies a recovery voltage to a source terminal of the driving element irrespective of an input image, thereby improving reliability of the pixels. The reverse polarity recovery voltage has an opposite polarity to a data voltage of the input image in a normal drive mode, in which a power-on state is maintained. For example, when the driving element DT (shown in FIG. 7) is implemented as an n-type metal oxide semiconductor field effect transistor (MOSFET), the data voltage of the input image in the normal drive mode may be a voltage of a positive polarity (or a voltage of a first polarity), and the reverse polarity recovery voltage may be a voltage of a negative polarity (or a voltage of a second polarity).

The recovery voltage applied to the source terminal of the driving element may be set to be greater than a gate voltage of the driving element applied during the power-on period. The reverse polarity recovery voltage and the recovery voltage applied to the source terminal of the driving element are generated for the power-on delay duration time Toff.

The power-on delay duration time Toff additionally determined in the embodiment of the invention is a period in which the logic power is continuously held until power to the panel driving circuit is really turned off after power to the organic light emitting display is turned off. The power-on delay duration time Toff is previously determined by a duration ranging from a time, at which the power input signal EL_ON falls to the low logic level, to a power-off start time, at which the logic power falls to a ground level.

Figure 4:
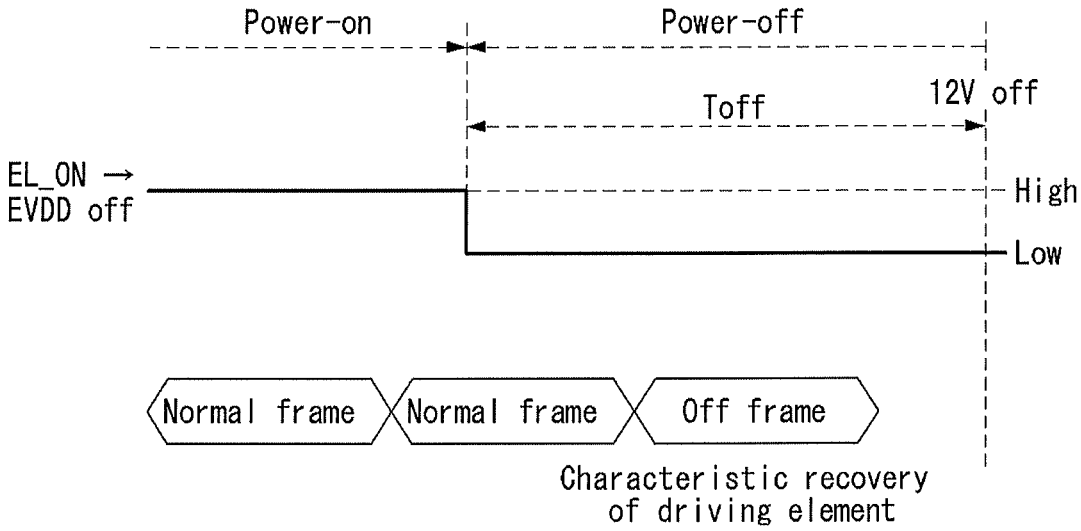
FIG. 4 is a waveform diagram showing a delay time of a logic power voltage in a power-off sequence process.

As shown in FIG. 4, the logic power used as a driving power source of the panel driving circuit is held at about 12V for the power-on delay duration time Toff after the power-off start time and then is reduced to a ground level voltage of 0V. When the logic power voltage is applied to the panel driving circuit, the panel driving circuit is normally driven. Therefore, the panel driving circuit is normally driven during the power-on period and the power-on delay duration time Toff and then generates an output. On the other hand, afterward, because the logic power voltage is not applied to the panel driving circuit, the panel driving circuit is not driven. Thus, the panel driving circuit does not generate the output during the power-off period after the power-on delay duration time Toff. The panel driving circuit may be temporarily driven by the logic power input when reaching a discharge time previously determined within the power-off period and may discharge the pixels.

The display panel 10 may include a plurality of data lines 14 and a plurality of gate lines 15 crossing the data lines 14. Pixels P may be arranged in a matrix form defined by a crossing structure of the data lines 14 and the gate lines 15. The gate lines 15 may include scan lines 15*a*, emission lines 15*b*, initialization lines 15*c*, etc. As shown in FIG. 7, each of the pixels P may include an organic light emitting diode (OLED), a driving element DT, switching elements S1, S2, and S3, a storage capacitor Cst, etc. Each of the pixels P may further include an internal compensation circuit. The internal compensation circuit is configured to sense a threshold voltage Vth of the driving element DT and adds the threshold voltage Vth to a data voltage Vdata of the input image, thereby compensating for the threshold voltage Vth of the driving element DT. The internal compensation circuit may use any known internal compensation circuit. Examples of the internal compensation circuit built in each pixel are disclosed in detail in U.S. patent application Ser. No. 12/292,849 (2008 Nov. 26), U.S. patent application Ser. No. 12/289,190 (2008 Oct. 22), U.S. patent application Ser. No. 12/953,028 (2010 Nov. 23), and U.S. patent application Ser. No. 13/213,794 (2011, Aug. 19) corresponding to the present applicant, all of which are hereby incorporated by reference in their entirety.

The sensing unit 30 may sense a change in characteristics of the driving element DT of each pixel P and supply the sensed change to the timing controller 11. The characteristics of the driving element DT may, for example, include a threshold voltage Vth, a mobility, and a parasitic capacitance Cox of the driving element DT. A method for sensing the change in the characteristics of the driving element DT may use any known method. The sensing unit 30 may then convert the change in the characteristics of the driving element DT of each pixel into digital data through an analog-to-digital converter (ADC) and transmit the digital data to the timing controller 11. The timing controller 11 may then control the reverse polarity recovery voltage to be proportional to the change in the characteristics of the driving element DT of each pixel as received from the sensing unit 30 in an external compensation method to be described later.

The timing controller 11 may rearrange digital video data RGB of the input image received from an external host system in conformity with the arrangement of the pixels of the display panel 10 in the normal drive mode, in which the power-on state is maintained, and supply the rearranged digital video data RGB to the data driving circuit 12. The host system may be implemented as one of a television system, a set-top box, a navigation system, a DVD player, a Blu-ray player, a personal computer (PC), a home theater system, and a phone system. The host system may transmit the digital video data RGB and timing signals Vsync, Hsync, CLK, and DE to be synchronized with the digital video data RGB from the timing controller 11.

In the normal drive mode, the timing controller 11 may generate a source timing control signal DDC for controlling operation timing of the data driving circuit 12 and a gate timing control signal GDC for controlling operation timing of the gate driving circuit 13 using the timing signals such as a vertical sync signal Vsync, a horizontal sync signal Hsync, a main clock CLK, and a data enable signal DE received from the host system. The source timing control signal DDC may include a source start pulse SSP, a source sampling clock SSC, a source output enable signal SOE, a polarity control signal POL, and the like. The source start pulse SSP may control a data sampling start timing of the data driving circuit 12, and the source sampling clock SSC may control a shift timing of a built-in shift register of the data driving circuit 12. The source output enable signal SOE controls an output timing of the data driving circuit 12. The polarity control signal POL may control a polarity of the data voltage and a polarity of the reverse polarity recovery voltage. In the normal drive mode, the polarity control signal POL may be held at a first logic level (for example, a high logic level), so that the polarity of the data voltage is maintained at the first polarity. Further, the polarity control signal POL for the power-on delay duration time Toff may be held at a second logic level (for example, a low logic level), so that the reverse polarity recovery voltage of the second polarity is generated for the power-on delay duration time Toff. Namely, the polarity control signal POL of the second logic level is not generated in the normal drive mode.

The gate timing control signal GDC may include a gate start pulse GSP defining start timing of gate signals, a gate shift clock GSC defining shift timing of the gate signal, a gate output enable signal GOE defining output timing of the gate signal, and the like.

Figure 5:
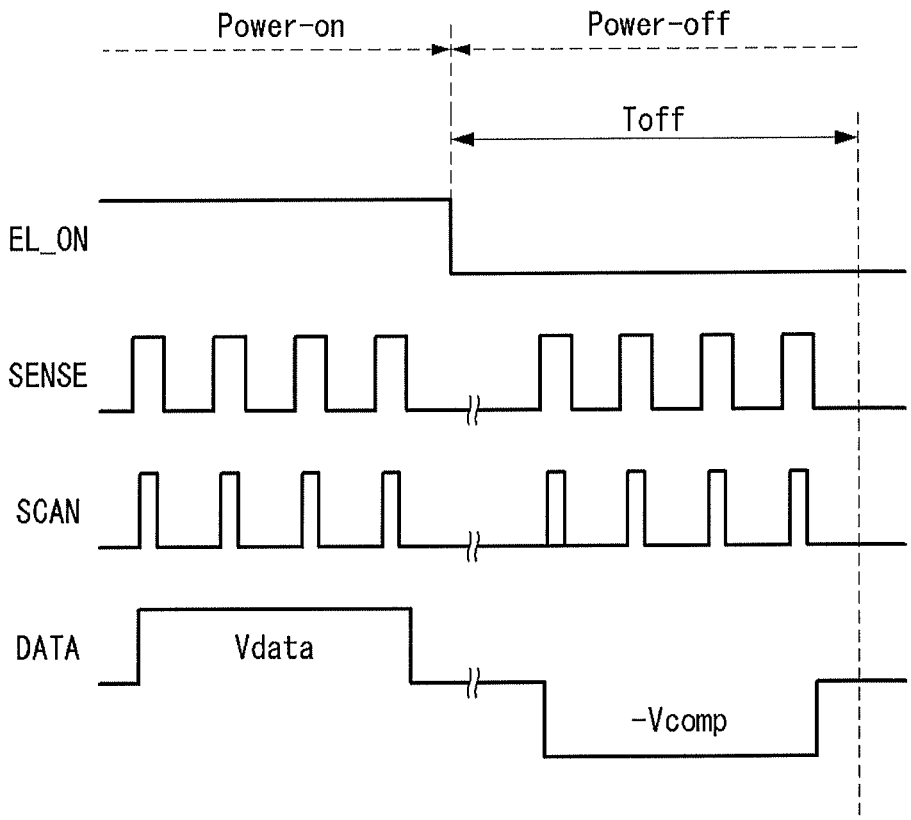
FIGS. 5 and 6 are waveform diagrams showing a reverse polarity recovery voltage generated for a power-on delay duration time.

In the normal drive mode, in which the power-on state is maintained, the data driving circuit 12 may convert the digital video data RGB of the input image received from the timing controller 11 into a gamma compensation voltage of the positive polarity (or the first polarity) to generate an analog data voltage Vdata (refer to FIG. 2) and supply the analog data voltage Vdata to the data lines 14. In the normal drive mode, the gate driving circuit 13 may generate the gate signals under the control of the timing controller 11 and select the pixels P to which the data voltage Vdata will be charged. Then, the gate driving circuit 13 may sequentially shift the gate signals on a per row line of a pixel array basis. As shown in FIG. 5, the gate signals may include a scan signal SCAN, a sense signal SENSE, etc., but are not limited thereto. The scan signal SCAN and the sense signal SENSE may be synchronized with the data voltage Vdata of the input image in the normal drive mode and may be synchronized with the reverse polarity recovery voltage during the power-on delay duration time Toff. Each of the scan signal SCAN and the sense signal SENSE may swing from between a gate high voltage VGH and a gate low voltage VGL. The gate high voltage VGH may be set to be equal to or greater than a threshold voltage of switching TFTs of the pixels P, and the gate low voltage VGL may be set to be less than the threshold voltage of the switching TFTs of the pixels P.

When the power input signal EL_ON is input at the voltage of the high logic level, the power supply unit 20 may generate a voltage of about 12V as the logic power voltage for driving the panel driving circuit. In the normal drive mode, the power supply unit 20 may hold the logic power voltage at about 12V. The power supply unit 20, may, for example, generate the electric power required to drive the pixels P, provide a high potential power voltage EVDD, provide a low potential power voltage EVSS, and provide a reference voltage Vref, during the power-on state. When the power input signal EL_ON is reduced to the voltage of the low logic level, the power supply unit 20 reduces the high potential power voltage EVDD back down to the ground level voltage, or 0V. The power supply unit 20 holds the output of the logic power voltage at about 12V, so that the panel driving circuit can normally operate during the power-on delay duration time Toff, and then reduces the logic power voltage to the ground level voltage or 0V. When the high potential power voltage EVDD is reduced to the ground level voltage, the pixels P cannot emit light because the current does not flow in the OLEDs of the pixels P.

The power supply unit 20 holds the logic power voltage at about 12V for the power-on delay duration time Toff, which lasts from the power-off start time point, at which the power input signal EL_ON is turned off, until the power to the panel driving circuit is turned off. Thus, the panel driving circuit normally operates for the power-on delay duration time Toff in a power-off sequence process, and then does not generate its output because the logic power voltage of 12V is not input. The power-on delay duration time Toff may be set to be equal to or longer than a length of one frame period and to be equal to or longer than about 50 msec, but is not limited thereto.

The timing controller 11 may control the data driving circuit 12 and the gate driving circuit 13 during the power-on delay duration time Toff, thereby recovering the characteristics of the driving element DT of each pixel P. Hence, the reliability of the pixels is improved. Because the pixels P do not emit light when, the user cannot perceive (e.g., visually) a characteristic recovery operation of the driving element DT performed during the power-on delay duration time Toff.

As described above, a method for recovering the characteristics of the driving element DT of each pixel P during the power-on delay duration time Toff may use a method for supplying the reverse polarity recovery voltage to the pixels P through the data lines 14 or a method for applying a high voltage to a source terminal of the driving element DT of each pixel P.

The method for supplying the reverse polarity recovery voltage to the pixels P through the data lines 14 may be a method for generating the reverse polarity recovery voltage using the data driving circuit 12 for the power-on delay duration time Toff. According to this method, the data driving circuit 12 may be additionally driven during the power-on delay duration time Toff, and converted digital compensation data may be received from the timing controller 11 into the gamma compensation voltage of the negative polarity (or the second polarity), thereby generating the reverse polarity recovery voltage Vcomp (refer to FIGS. 5 and 6). The data driving circuit 12 may then supply the reverse polarity recovery voltage Vcomp to the data lines 14. The gate driving circuit 13 may generate the gate signals under the control of the timing controller 11 for the power-on delay duration time Toff and select the pixels P to which the reverse polarity recovery voltage Vcomp will be supplied. The gate driving circuit 13 may sequentially shift the gate signals on a per row line of the pixel array basis.

The method for applying a recovery voltage to the source terminal of the driving element DT of each pixel P may also be a method for supplying a voltage greater than the gate voltage to the source terminal of the driving element DT during the power-on delay duration time Toff. The timing controller 11 may adjust the recovery voltage applied to the source terminal based on a recovery value. The recovery value may be calculated by the timing controller as shown in FIGS. 14 to 19. According to this method, the gate voltage of the driving element DT may be less than the source voltage of the driving element DT, and thus the characteristics of the driving element DT are recovered. The method may be implemented by a method for increasing the reference voltage Vref supplied to the source terminal of the driving element DT through the control of the reference voltage generator 22 for the power-on delay time Toff. In the method, the data driving circuit 12 does not need to output the reverse polarity recovery voltage.

A method for recovering the characteristics of the driving element DT may be considered in the normal drive mode, in which the power-on state is maintained. The compensation method in the normal drive mode may multiply a frame rate or divide a frame period, so as to secure a compensation time required to apply a compensation voltage different from the data voltage to the pixels. However, because the compensation method in the normal drive mode relatively reduces a data display period of the pixels by the compensation time, the display quality may be reduced. Thus, the sufficiently high compensation voltage may be applied to the pixels P, so as to reduce the compensation time. However, in this instance, power consumption may increase. On the other hand, this embodiment of the invention supplies the compensation voltage to the pixels after the power of the organic light emitting display is turned off, and thus may not change the normal driving method, and may also recover the characteristics of the driving elements DT during a period not affecting the quality of the input image. Further, the embodiment of the invention may supply the compensation voltage to the pixels P for the sufficiently long power-on delay duration time Toff, and thus may generate the compensation voltage of the low logic level.

Figure 2:
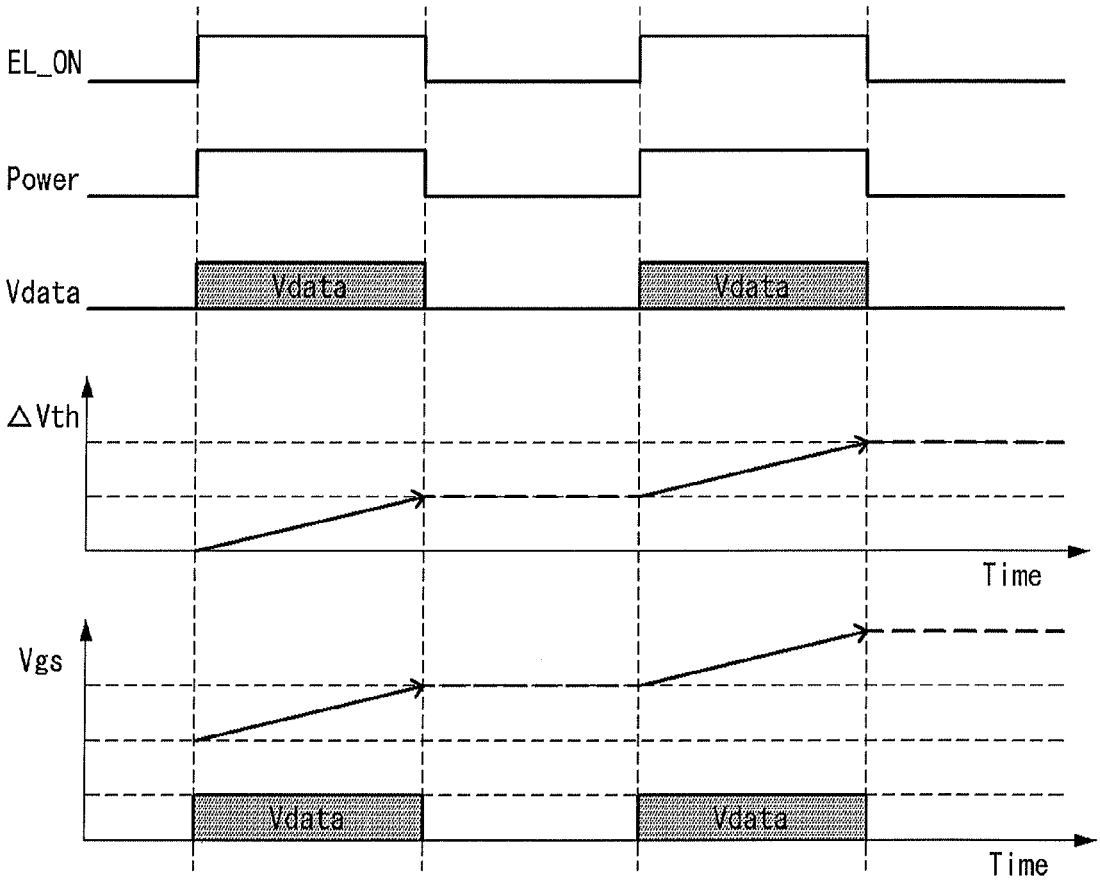
FIG. 2 illustrates an example of a change in characteristics of a driving element as a use time of the driving element increases.

FIG. 2 illustrates an example of change in characteristics of the driving element as a use time of the driving element increases.

As shown in FIG. 2, the power input signal EL_ON is a signal of the high logic level in the power-on state and is reduced to a signal of the low logic level in the power-off state. In the normal drive mode, in which the power-on state is maintained, the data voltage Vdata of the input image is supplied to the driving element DT of each pixel P. The data voltage Vdata may be the voltage having any one polarity. For example, when the driving element DT is implemented as the n-type MOSFET, the data voltage Vdata may be a positive voltage. If the data voltage Vdata is a negative voltage when the driving element DT is implemented as the n-type MOSFET, the gate voltage of the driving element DT may be less than the source voltage of the driving element DT. Further, the driving element DT may be maintained in a turn-off state, during which the current cannot flow in the OLED. Thus, the data voltage Vdata of the same polarity may be repeatedly applied to the gate of the driving element DT in the normal drive mode. Because of this, the threshold voltage Vth of the driving element DT in the power-on state may increase due to a positive gate bias stress as time passed. As a result, a gate-source voltage VGS of the driving element DT increases.

Further, the power input signal EL_ON is grounded to the low logic level in the power-off state. In general, the characteristics of the driving element DT in the power-off state remain in a previous state. When the organic light emitting display is powered on and is normally driven again in the power-on state, the threshold voltage Vth and the gate-source voltage VGS of the driving element DT again increase because the gate bias stress of the driving element DT is increased by every power-on state. As described above, when the threshold voltage Vth and the gate-source voltage VGS of the driving element DT increase, the current flowing in the OLED varies even if the same data voltage Vdata is applied to the driving element DT. Hence, a luminance of the pixel P at the same gray level varies, and the reliability of the pixel P is reduced. Further, life span of the organic light emitting display is reduced because of the degradation of the driving elements DT.

Figure 3:
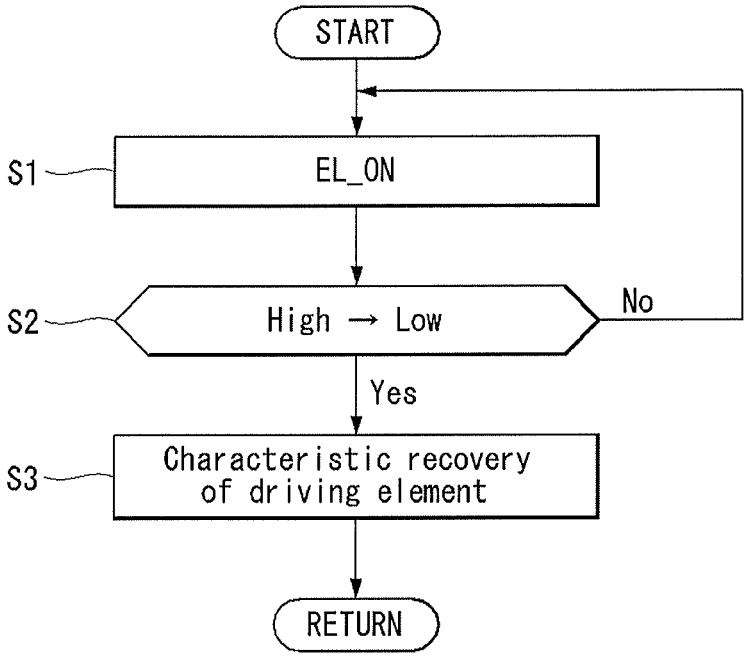
FIG. 3 is a flow chart illustrating a method for driving an organic light emitting display according to an example embodiment of the invention.
Figure 8:
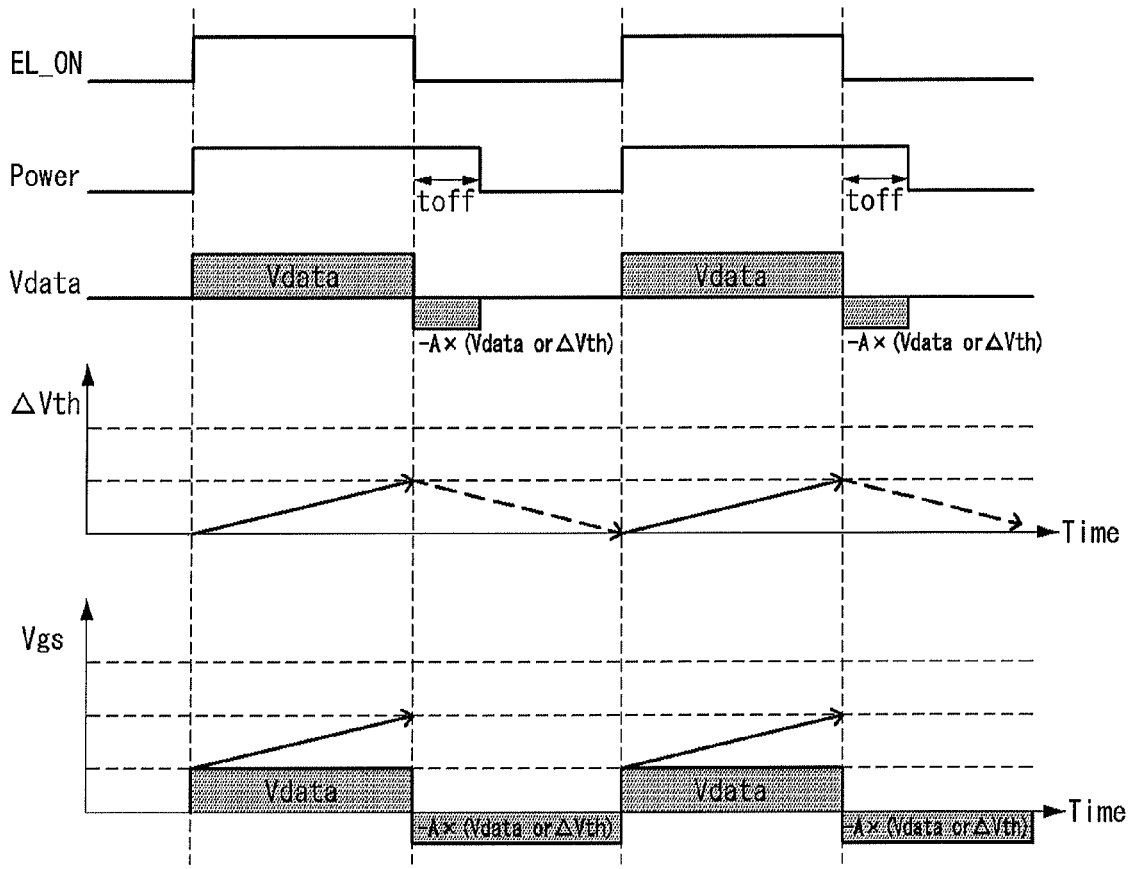
FIGS. 8 and 9 illustrate a change in characteristics of a driving element in a power-on state and a power-off state of an organic light emitting display according to an example embodiment of the invention.

However, the organic light emitting display according to the present invention continues to provide the compensation voltage to the panel driving circuit for a set time period to allow recovering of the characteristics of the driving elements DT during the power-off state, even after turning the power to the organic light emitting display off, as shown in FIGS. 3 and 4. Therefore, the present invention is able to recover the characteristics of the driving elements DT even after turning the power to the OLED itself off, as shown in FIG. 8.

The organic light emitting display according to the present invention may generate the compensation voltage that is set to a higher voltage than the gate voltage of the driving element, when the driving element suffers from a positive gate bias stress during the power-on state. In addition or alternatively, the organic light emitting display according to present the invention may generate the compensation voltage that is set to a lower voltage than the gate voltage of the driving element, when the driving element suffers from a negative gate bias stress during the power-on state.

FIG. 3 is a flow chart illustrating a method for driving the organic light emitting display according to the embodiment of the invention. FIG. 4 is a waveform diagram showing the power-on delay time Toff.

As shown in FIGS. 3 and 4, the timing controller 11 senses a change in the power input signal EL_ON and decides power-off start timing when the power input signal EL_ON is reduced to be equal to or less than a predetermined reference value, in steps S1 and S2. The timing controller 11 controls the data driving circuit 12 and the gate driving circuit 13 for the power-on delay time Toff from the power-off start timing. Hence, the timing controller 11 supplies the reverse polarity recovery voltage Vcomp (refer to FIGS. 5 and 6) to the pixel P through the data lines 14, or supplies the recovery voltage to the source terminal of the driving element DT, thereby recovering the characteristics of the driving element DT in step S3. Thus, the organic light emitting display according to the embodiment of the invention recovers the characteristics of the driving elements DT of the pixels P during the power-off state. The user cannot perceive (e.g., visually) the characteristic recovery operation of the driving elements DT performed in the power-off state because the pixels P do not emit light during this time. In other words, a black screen is displayed on the display panel 10 during the power-off state.

In the normal drive mode, in which the power-on state is maintained, the timing controller 11 transmits the digital video data of the input image to the data driving circuit 12, controls the data driving circuit 12 and the gate driving circuit 13 using a normal driving method, and writes the digital video data of the input image to the pixels P. Each of the pixels P is updated with the data in each frame period. In FIG. 4, 'normal frame' indicates a frame period in which the data of the input image is written to the pixels P in the power-on state. In FIG. 4, the normal frame between the power-on state and the power-off state is a frame period in which the remaining data is written to the pixels when the power-on state is converted into the power-off state in the process of writing the data to the pixels in the power-on state.

When the power input signal EL_ON is reduced to the low logic level, the timing controller 11 decides the power-off start timing and normally writes the remaining data to the pixels for the power-on delay time Toff, in which the logic power voltage of about 12V is held. The timing controller 11 then controls the characteristic recovery of the driving element. In FIG. 4, 'off-frame' indicates a frame period in which the characteristics of the driving element are recovered within the power-on delay time Toff. One or more off-frames may be assigned to the power-on delay time Toff.

Figure 6:
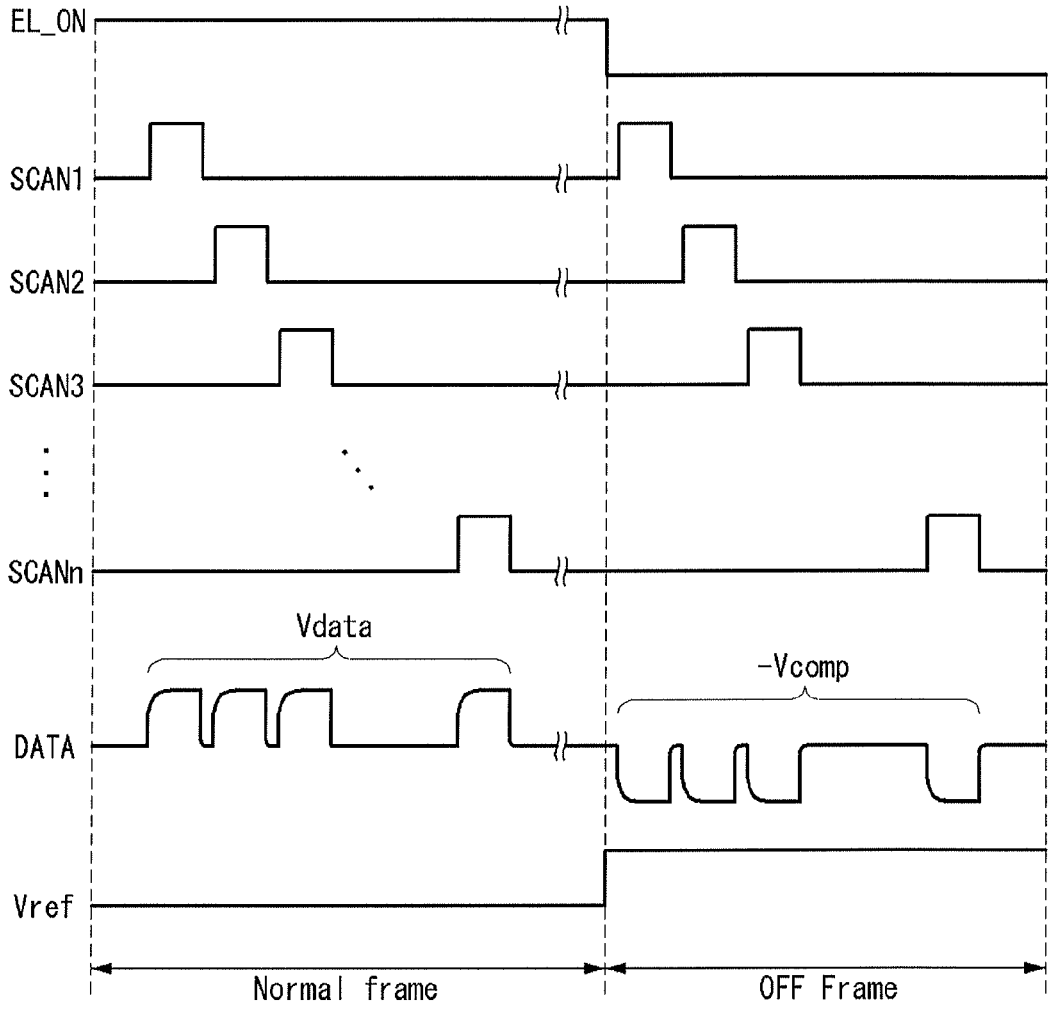

FIGS. 5 and 6 are waveform diagrams showing the reverse polarity recovery voltage generated for the power-on delay time Toff. FIG. 7 illustrates a method for sensing the characteristics of the driving elements of the pixels.

As shown in FIGS. 5 to 7, each of the pixels P includes the switching elements S1, S2, and S3, the driving element DT, the storage capacitor Cst, the OLED, etc. Each pixel P may include the internal compensation circuit (not shown). The switching elements S1, S2, and S3 and the driving element DT may be implemented as the n-type MOSFET, but are not limited thereto.

The first switching element S1 supplies the data voltage Vdata or the reverse polarity recovery voltage Vcomp from the data line 14 to the gate of the driving element DT in response to the scan signal SCAN. A gate terminal of the first switching element S1 is connected to the scan line 15*a*, and a drain terminal of the first switching element S1 is connected to the data line 14. A source terminal of the first switching element S1 is connected to a gate terminal of the driving element DT.

In the normal drive mode, the second switching element S2 supplies the reference voltage Vref of low potential to a node between the source terminal of the driving element DT and an anode of the OLED in response to the sense signal SENSE in the power-on state, thereby initializing the anode of the OLED. Further, in a sensing mode, the second switching element S2 connects the node between the source terminal of the driving element DT and the anode of the OLED to the sensing unit 30. A gate terminal of the second switching element S2 is connected to the initialization line 15*c*, and a drain terminal of the second switching element S2 is connected to the node between the source terminal of the driving element DT and the anode of the OLED. A source terminal of the second switching element S2 is connected to the third switching element S3.

The sensing mode is activated each time the driving characteristics of the pixels P need to be sensed in the power-on state and the power-on delay time Toff. The third switching element S3 connects the second switching element S2 to the reference voltage generator 22 in the normal drive mode of the power-on state. On the other hand, the third switching element S3 connects the second switching element S2 to the sensing unit 30 in the sensing mode.

The reference voltage generator 22 generates the reference voltage Vref of low potential for initializing the anode of the OLED of the pixel in the normal drive mode. In the method for applying the recovery voltage to the source terminal of the driving element DT for the power-on delay time Toff, the reference voltage generator 22 increases the reference voltage Vref for the power-on delay time Toff, and thus the source voltage of the driving element DT may be greater than the gate voltage of the driving element DT.

When the first and second switching elements S1 and S2 are turned on and the sensing unit 30 is connected to the second switching element S2 through the third switching element S3, the sensing unit 30 senses a change in the characteristics of the driving element DT. The sensing unit 30 senses a change in the voltage or the current flowing through the node between the source terminal of the driving element DT and the anode of the OLED, thereby sensing the change in the characteristics (for example, the threshold voltage Vth, the mobility, etc.) of the driving element DT. The sensing unit 30 converts the received signal into digital data through the ADC and transmits the digital data to the timing controller 11.

The timing controller 11 stores data (hereinafter referred to as "sensing data") from the sensing unit 30 in a memory (not shown). The timing controller 11 analyzes the sensing data stored in the memory and calculates a value of digital compensation data in proportion to a change amount of the characteristics of the driving element DT. The timing controller 11 controls a level of the reverse polarity recovery voltage in proportion to the change amount of the characteristics of the driving element DT using the digital compensation data. Further, the timing controller 11 may calculate the digital compensation data in proportion to an average of the data voltages written to the pixels P during the power-on state. Hence, the timing controller 11 may control the level of the reverse polarity recovery voltage in proportion to the average of the data voltages. The timing controller 11 controls the reference voltage generator 22 and thus may adjust the voltage, which is applied to the source terminal of the driving element DT for the power-on delay time Toff, in proportional to the average of the data voltages written to the pixels P or the change amount of the characteristics of the driving element DT during the power-on state.

In the organic light emitting display according to the embodiment of the invention, the method for recovering the characteristics of the driving element DT performed for the power-on delay time Toff may be divided into an internal compensation method and an external compensation method.

In the inner compensation method, an internal compensation circuit is built in each of the pixels.

The internal compensation circuit may sense the threshold voltage Vth of the driving element DT of each pixel, but it is difficult for the internal compensation circuit to generate the compensation voltage for recovering the characteristics of the driving element DT. Thus, in the inner compensation method, the timing controller 11 generates the digital compensation data and supplies the digital compensation data to the data driving circuit 12 or the reference voltage generator 22. The data driving circuit 12 converts the digital compensation data into the reverse polarity recovery voltage for the power-on delay time Toff and supplies the reverse polarity recovery voltage to the pixels P through the data lines 14. The reference voltage generator 22 causes the reference voltage Vref applied to the source terminal of the driving element DT to be greater than the gate voltage of the driving element DT in response to the digital compensation data for the power-on delay time Toff.

In the inner compensation method, the timing controller 11 may select a compensation value (or digital compensation data) as a value proportional to the average of the data voltages Vdata applied to each pixel P. As an example of a method for estimating the data voltage, the timing controller 11 stores the digital video data of the input image in the memory on a per pixel basis during the power-on state and adds them to estimate the average of the data voltages Vdata. Further, as another example of the method for estimating the data voltage, the timing controller 11 samples the digital video data of the input image every predetermined period of time during the power-on state, stores the sampled digital video data in the memory on a per pixel basis, and adds them, thereby estimating the average of the data voltages Vdata.

In the inner compensation method, the timing controller 11 may calculates an average of the digital video data to be written to all of the pixels P of the display panel 10 and may select the compensation value proportional to the average, so as to reduce a capacity of the memory. The compensation value controls the digital compensation data, i.e., the reverse polarity recovery voltage supplied to the pixels P through the data lines 14 or the recovery voltage supplied to the source terminal of the driving element DT. Further, in the inner compensation method, the timing controller 11 may calculate an average of each color and may select the compensation value proportional to the average, so as to reduce the memory capacity. Each of the pixels P may include four red (R), green (G), blue (B) and white (W) subpixels. As an example, the timing controller 11 may calculate an average of red data, an average of green data, an average of blue data, and an average of white data and may select a compensation value of red subdata proportional to the average of red data, a compensation value of green subdata proportional to the average of green data, a compensation value of blue subdata proportional to the average of blue data, and a compensation value of white subdata proportional to the average of white data. The average of each color may be calculated by the average of each color calculated during the power-on state or the average of each color sampled every predetermined period of time in the power-on state.

The external compensation method may use all of the methods for selecting the compensation value applied to the inner compensation method. Because the external compensation method can accurately sense the change in the characteristics of the driving element DT of each pixel P through the sensing unit 30, the external compensation method may select a compensation value proportional to a change amount of the characteristics of each pixel P. The change in the characteristics of the driving element DT in the external compensation method may include a change in the threshold voltage Vth and a change in the mobility of the driving element DT.

Figure 9:
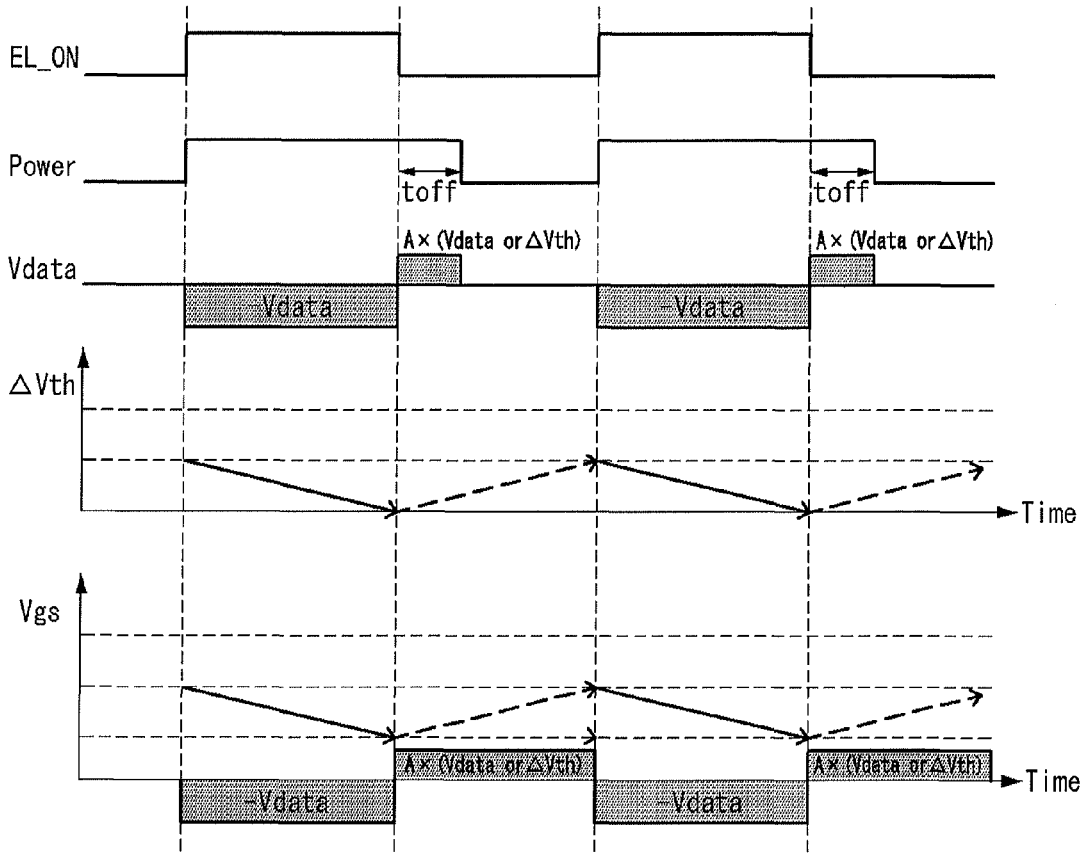

FIGS. 8 and 9 illustrate a change in the characteristics of the driving element in the power-on state and the power-off state of the organic light emitting display according to the embodiment of the invention. As shown in FIG. 8, the organic light emitting display according to the embodiment of the invention recovers the characteristics of the driving element DT in each power-off state. Thus, the organic light emitting display according to the embodiment of the invention periodically recovers the shift of the threshold voltage Vth or the gate-source voltage VGS of the driving element DT. The timing controller 11 multiplies the average of the data voltages Vdata or the change amount of the characteristics of the driving element DT by a proportional constant '−A' to select the compensation value. Hence, the timing controller 11 may control the reverse polarity recovery voltage proportional to the average of the data voltages Vdata or the change amount of the characteristics of the driving element DT.

When the driving element DT is implemented as a p-type MOSFET, in the normal drive mode, the data voltage of the input image is a voltage of the negative polarity (or a voltage of the second polarity), and the reverse polarity recovery voltage is a voltage of the positive polarity (or a voltage of the first polarity). In this instance, as shown in FIG. 8, because the negative data voltage −Vdata is continuously applied to the driving element DT, the driving element DT suffers from a negative gate bias stress. Hence, a threshold voltage ΔVth of the driving element DT is reduced as time passed. As shown in FIG. 9, the panel driving circuit supplies a positive recovery voltage to the pixels or supplies a voltage less than the gate voltage to the source terminal of the driving element DT for the power-on delay duration time Toff, so as to recover the characteristics of the driving element DT by compensating for the negative gate bias stress.

In general, because an amount of a leakage current of the display panel is not much, the panel driving circuit does not need to continuously apply the recovery voltage to the pixels during the entire power-off period. As shown in FIGS. 8 to 13, the organic light emitting display according to the embodiment of the invention applies the recovery voltage to the pixels for the power-on delay duration time Toff determined immediately before the logic power is turned off. In this way, when the logic power is turned off after the recovery voltage is applied to the pixels, the pixels are held at the recovery voltage before a next power-on period starts.

The recovery of the driving characteristics of the pixels is affected by the recovery voltage and a recovery time. The recovery time is a time required to hold the pixel at the recovery voltage within the power-off period after the pixel is charged to the recovery voltage. The recovery voltage and the recovery time have to be properly determined in consideration of the data voltage, an amount ΔVth of change in the threshold voltage of the driving element DT during the power-on period, etc. This is described in detail below with reference to FIGS. 10 to 19.

Figure 10:
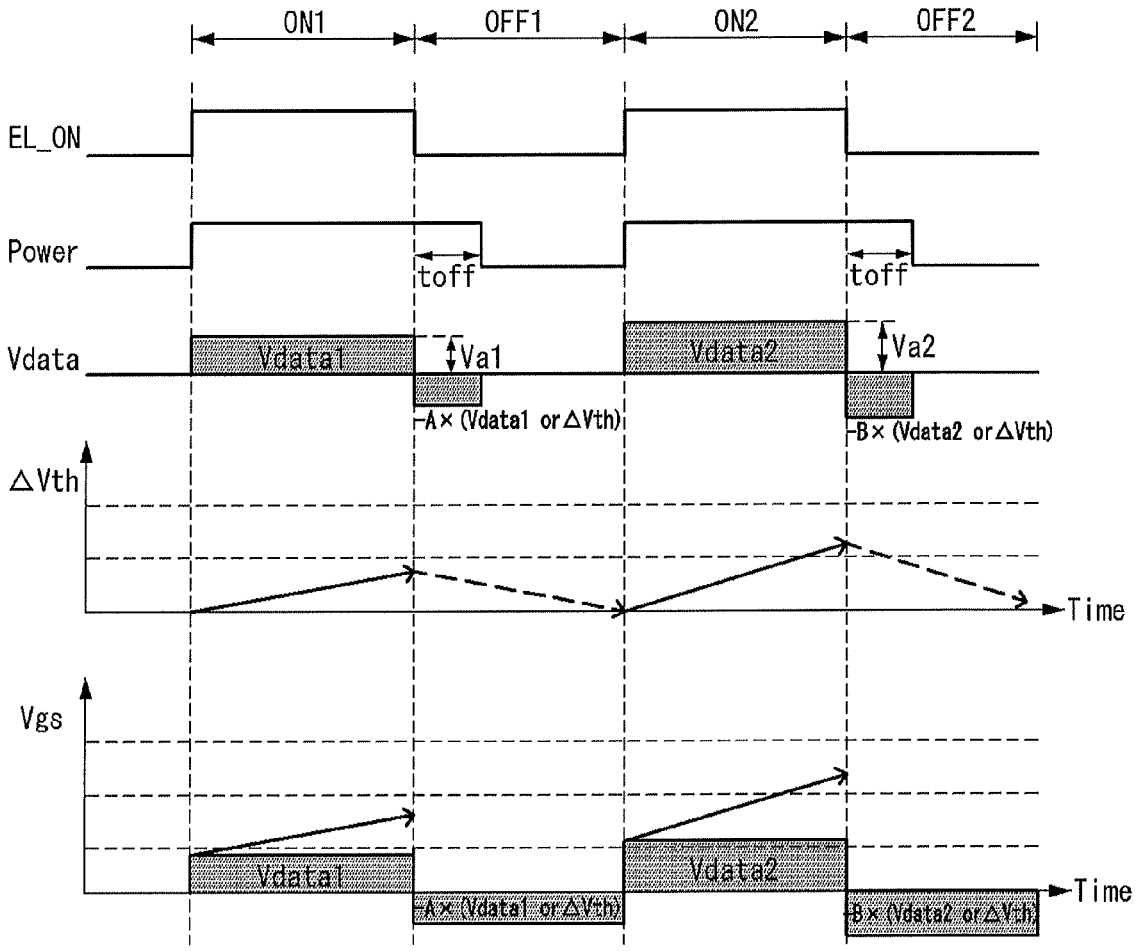
FIG. 10 illustrates an example of increasing a recovery voltage as a data voltage increases or an amount of change in a threshold voltage of a driving element increases.

As shown in FIG. 10, as the data voltage Vdata applied to the pixel during the power-on period increases or the amount ΔVth of change in the threshold voltage of the driving element DT increases, the recovery voltage applied to the pixels for the power-on delay duration time Toff increases. In the embodiment of the invention, the data voltage Vdata may be an average of the data voltages supplied during one power-on period. In an example illustrated in FIG. 10, when a second data voltage Vdata2 (=Va2) applied to the pixel during a second power-on period ON2 is greater than a first data voltage Vdata1 (=Va1) applied to the pixel during a first power-on period ON1, a second recovery voltage −Vcomp2 (=−B (Vdata2 or ΔVth) is greater than a first recovery voltage −Vcomp1 (=−A(Vdata1 or ΔVth). The first recovery voltage −Vcomp1 is a recovery voltage applied to the pixel for a power-on delay duration time Toff determined at the beginning of a first power-off period OFF1 immediately after the first power-on period ON1 ends. The second recovery voltage −Vcomp2 is a recovery voltage applied to the pixel for a power-on delay duration time Toff determined at the beginning of a second power-off period OFF2 immediately after the second power-on period ON2 ends. Thus, the embodiment of the invention sets a second proportional constant 'B' to be greater than a first proportional constant 'A', thereby controlling the first and second recovery voltages.

Figure 11:
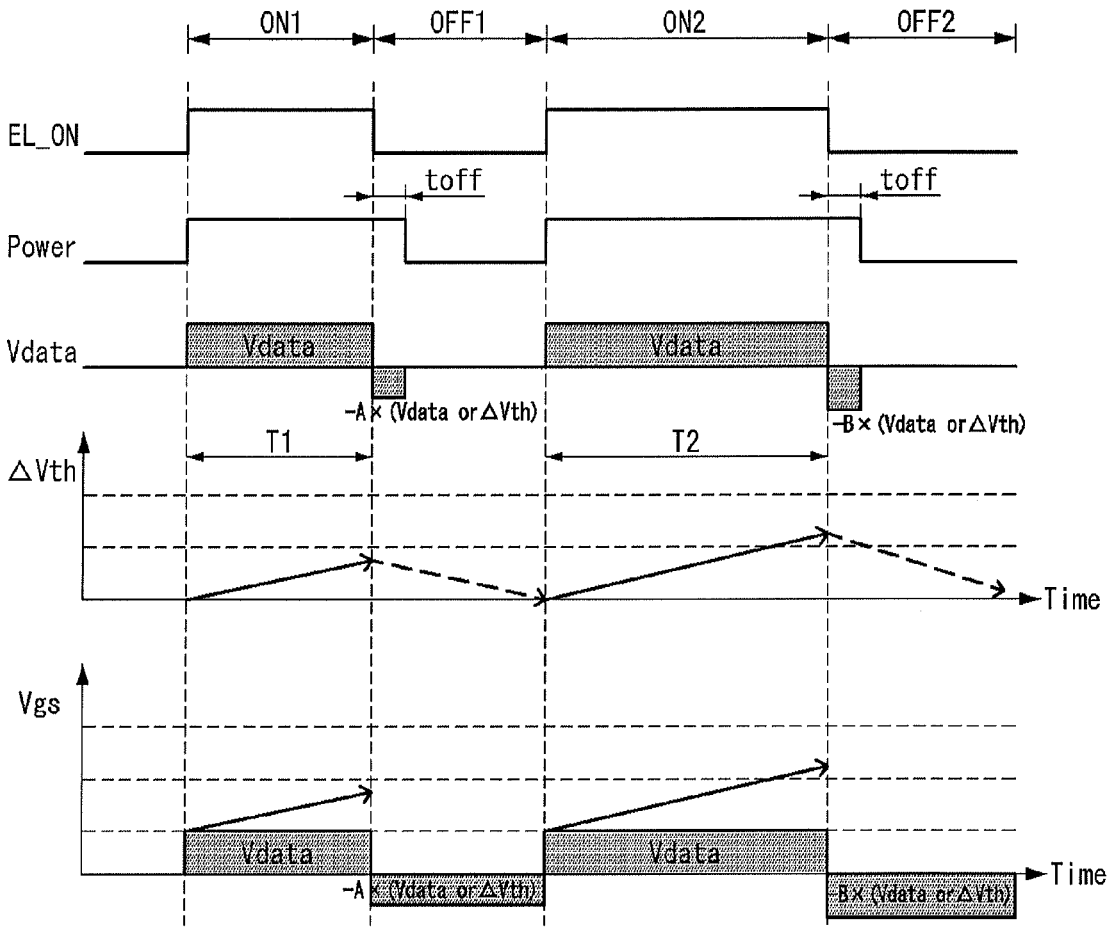
FIG. 11 illustrates an example of increasing a recovery voltage as a length of a power-on period increases.
Figure 12:
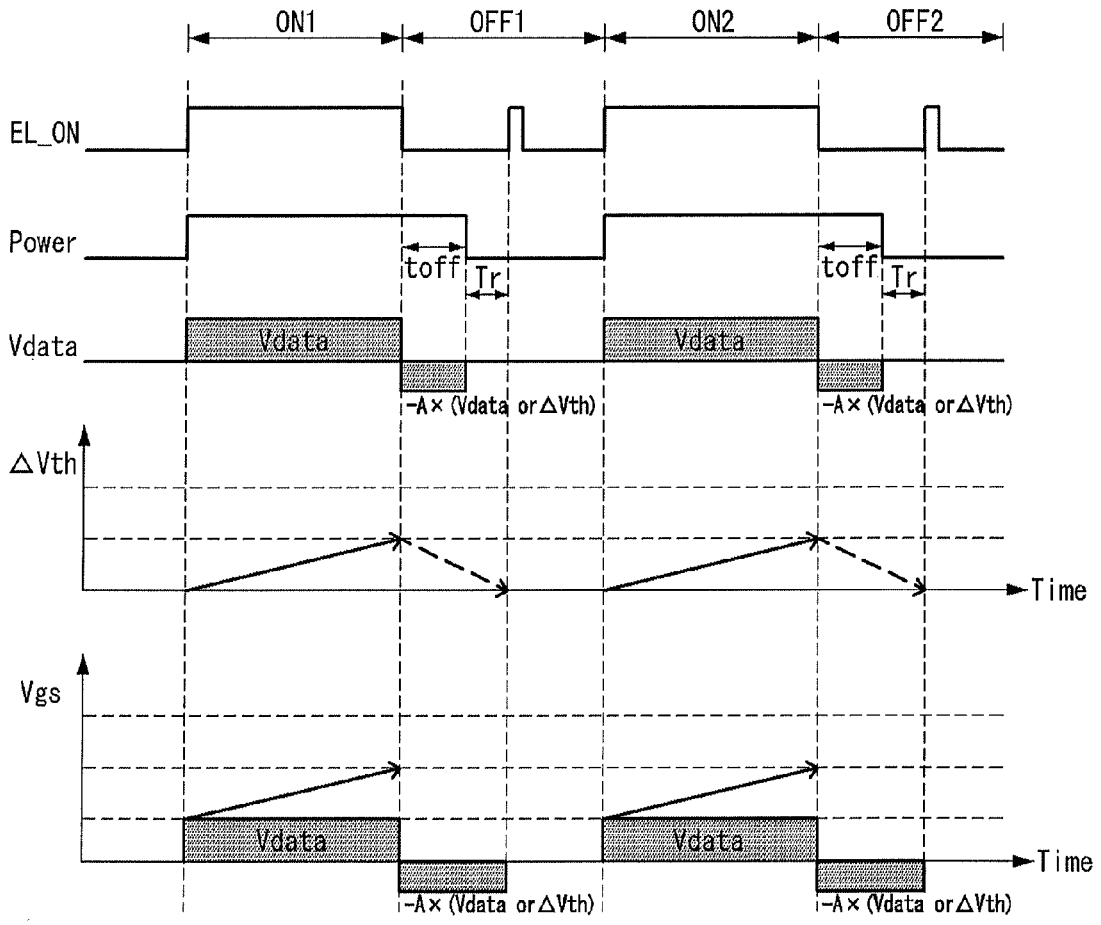
FIGS. 12 and 13 illustrate a method for controlling a recovery time.

As shown in FIG. 11, the degradation of the pixel resulting from the change in the driving characteristics of the driving element DT is affected by an operation time, namely, the power-on period as well as the data voltage Vdata. When the power-on periods ON1 and ON2 lengthen, a duration of a gate bias stress of the driving element DT increases. Thus, the amount ΔVth of change in the threshold voltage of the driving element DT increases. The recovery voltage sets to increase in proportion to the length of the power-on period in consideration of the operation time. In an example illustrated in FIG.

11, when a length of a second power-on period ON2 (=T2) is greater than a length of a first power-on period ON1 (=T1), a second recovery voltage −Vcomp2 (=−B(Vdata2 or ΔVth) is greater than a first recovery voltage −Vcomp1 (=−A(Vdata1 or ΔVth). Thus, the embodiment of the invention sets a second proportional constant 'B' to be greater than a first proportional constant 'A', thereby controlling the first and second recovery voltages.

As a previous recovery time increases, the degradation of the pixels decreases. Because of this, the recovery voltage has to be properly calculated in consideration of a previous power-off period. For example, the recovery voltage may decrease as a previous average power-off period lengthens. Thus, the proportional constants 'A' and 'B' may be properly determined in consideration of power-off periods OFF1 and OFF2 corresponding to the recovery time of the pixel as well as the power-on periods ON1 and ON2. The power-on periods ON1 and ON2 and the power-off periods OFF1 and OFF2 may be measured using a timer of the host system. The host system may calculate an average of previous power-on periods ON1 and ON2 measured by the timer and estimate a next recovery time based on a result of the average, thereby determining the proportional constant. The proportional constant decreases as the average of the previous power-off periods increases.

The degradation of the pixels is greatly affected by the recovery time. The recovery time may be properly calculated in consideration of the data voltage Vdata, the power-on period, the power-off period, etc. in the same manner as the proportional constant. For example, the recovery time in one power-off period increases as the data voltage Vdata and the amount ΔVth of change in the threshold voltage of the driving element DT increase and also as the power-on period lengthens. Further, the recovery time may decrease as the average of the previous power-off periods increases. A recovery time Tr may be controlled using a method illustrated in FIGS. 12 and 13.

Figure 13:
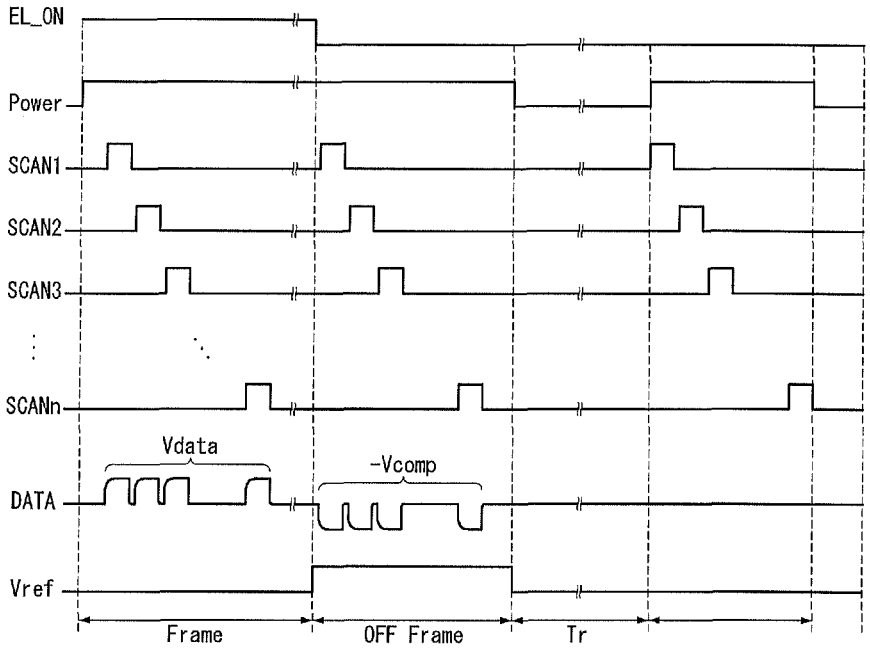

The host system measures the recovery time using the timer and supplies the input voltage to the power supply unit 20 when reaching a previously determined recovery time Tr. Hence, the panel driving circuit is temporarily driven. As shown in FIG. 13, when the previously determined recovery time Tr is reached, the panel driving circuit applies the scan signal to the scan lines and discharges the gate voltage (i.e., the recovery voltage) of the driving element DT. The gate voltage of the driving element DT is discharged through the switching element S1 and the data line 14.

Figure 14:
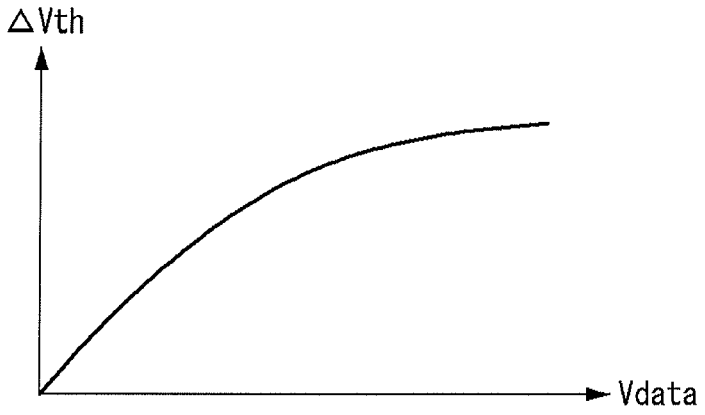
FIG. 14 is a graph showing an amount of change in a threshold voltage of a driving element depending on a data voltage.

FIG. 14 is a graph showing the amount ΔVth of change in the threshold voltage of the driving element DT depending on the data voltage. As shown in FIG. 14, the amount ΔVth of change in the threshold voltage of the driving element DT is proportional to a data voltage Vdataβ applied to the gate of the driving element DT during the power-on period, where β is less than 1.

Figure 15:
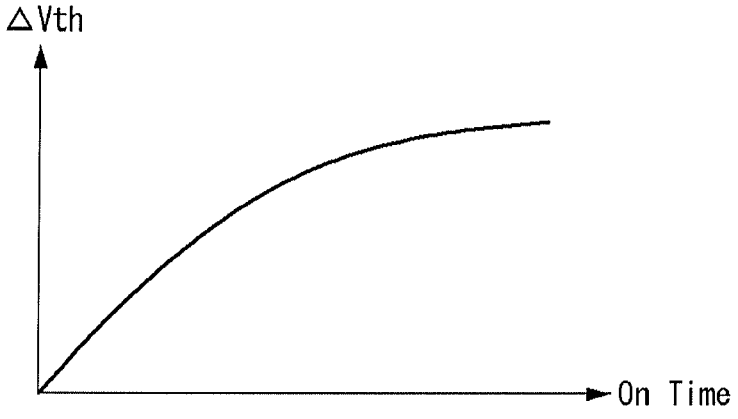
FIG. 15 is a graph showing an amount of change in a threshold voltage of a driving element depending on a power-on period.

FIG. 15 is a graph showing the amount ΔVth of change in the threshold voltage of the driving element DT depending on the power-on period. As shown in FIG. 15, the amount ΔVth of change in the threshold voltage of the driving element DT is proportional to a duration Θ of the power-on period 'On time' in which the gate bias stress of the driving element DT increases, where Θ is less than 1.

Figure 16:
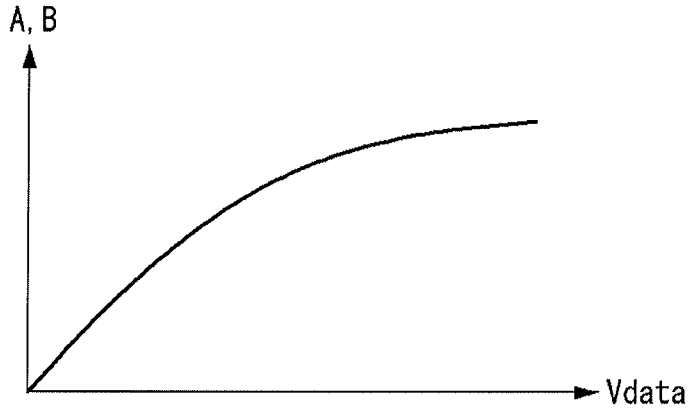
FIG. 16 is a graph showing a proportional constant depending on a data voltage.

FIG. 16 is a graph showing the proportional constants 'A' and 'B' depending on the data voltage. As shown in FIG. 16, the proportional constants 'A' and 'B' are calculated to a value proportional to the data voltage Vdata.

Figure 17:
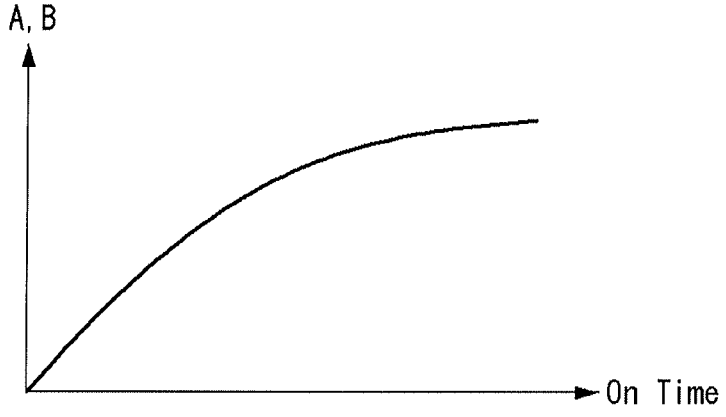
FIG. 17 is a graph showing a proportional constant depending on a power-on period.

FIG. 17 is a graph showing the proportional constants 'A' and 'B' depending on the power-on period 'On time'. As shown in FIG. 17, the proportional constants 'A' and 'B' are calculated to a value proportional to the power-on period 'On time'.

Figure 18:
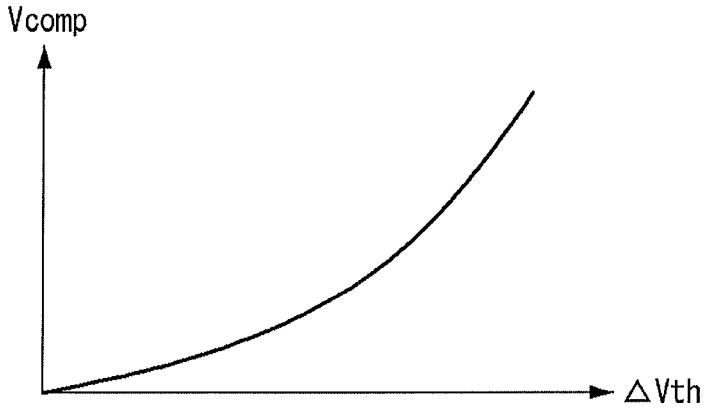
FIG. 18 is a graph showing a recovery voltage depending on an amount of change in a threshold voltage of a driving element.

FIG. 18 is a graph showing a recovery voltage Vcomp depending on the amount ΔVth of change in the threshold voltage of the driving element DT. As shown in FIG. 18, the recovery voltage Vcomp is calculated to a value proportional to the amount ΔVth of change in the threshold voltage of the driving element DT. The graph shown in FIG. 18 is similar to a graph obtained by exchanging an x-axis and a y-axis in the graph shown in FIG. 14.

Figure 19:
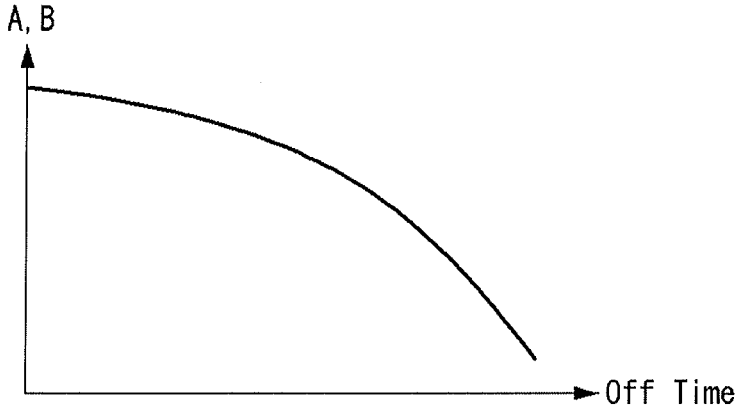
FIG. 19 is a graph showing a proportional constant depending on a power-off period.

FIG. 19 is a graph showing the proportional constants 'A' and 'B' depending on a power-off period 'Off time'. As shown in FIG. 19, the proportional constants 'A' and 'B' are calculated to a value inversely proportional to the power-off period 'Off time'. For example, the proportional constants 'A' and 'B' increase as the power-off period 'Off time' corresponding to the recovery period shortens.

As described above, the embodiment of the invention supplies the reverse polarity recovery voltage to the gate of the driving element or supplies the recovery voltage greater than the gate voltage of the driving element to the source terminal of the driving element in the power-off sequence process, thereby recovering the characteristics of the driving elements of the pixels. According to some embodiments, the power-on delay duration time during which the recovery voltage is supplied, may be calculated to be inversely related to an amplitude of the recovery voltage. For example, a lower amplitude recovery voltage may be supplied for a longer time in comparison to a higher amplitude recovery voltage which may be supplied for a shorter time.

As a result, because the embodiment of the invention recovers the characteristics of the driving elements in the power-off sequence process irrespective of the display quality of the input image, the embodiment of the invention may recover the characteristics of the driving elements to the low voltage without changing the normal driving method of the power-on state.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel including data lines, gate lines crossing the data lines, and pixels; and a panel driving circuit which supplies a data voltage to the pixels of the display panel during a power-on period and then is additionally driven for a predetermined power-on delay duration time delayed from a power-off start time of a power input signal, wherein the panel driving circuit supplies a reverse polarity recovery voltage having a polarity opposite the data voltage to the pixels or supplies a recovery voltage, which is different from a gate voltage of a driving element of each of the pixels, to a source terminal of the driving element of each pixel for the predetermined power-on delay duration time and, wherein the predetermined power-on delay duration time is determined by a duration ranging from a time, at which power to the organic light emitting display is turned off, to a time, at which power to the panel driving circuit is turned off.

2. The organic light emitting display of claim 1, wherein when the driving element suffers from a positive gate bias stress during the power-on period, the panel driving circuit generates the recovery voltage, greater than the gate voltage of the driving element, supplied to the source terminal of the driving element.

3. The organic light emitting display of claim 1, wherein when the driving element suffers from a negative gate bias stress during the power-on period, the panel driving circuit generates the recovery voltage, less than the gate voltage of the driving element, supplied to the source terminal of the driving element.

4. The organic light emitting display of claim 1, further comprising a power supply unit configured to generate a logic power voltage required to drive the panel driving circuit when the power input signal is generated at a high logic level, and when the power input signal is reduced to a low logic level, maintain an output of the logic power voltage for the power-on delay duration time to additionally drive the panel driving circuit for the power-on delay duration time.

5. The organic light emitting display of claim 1, wherein the panel driving circuit includes:

a data driving circuit configured to convert digital video data of an input image into the data voltage during the power-on period to supply the data voltage to the data lines and convert a recovery value into the reverse polarity recovery voltage for the power-on delay duration time to supply the reverse polarity recovery voltage to the data lines;

a gate driving circuit configured to sequentially supply gate signals to the gate lines during the power-on period and for the power-on delay duration time; and a timing controller configured to transmit the digital video data of the input image to the data driving circuit during the power-on period, transmit the recovery value to the data driving circuit for the power-on delay duration time, and control operation timing of the data driving circuit and operation timing of the gate driving circuit.

6. The organic light emitting display of claim 5, wherein the timing controller generates the recovery value as a value proportional to an average of the digital video data during the power-on period.

7. The organic light emitting display of claim 5, wherein the timing controller samples the digital video data every predetermined period of time during the power-on period and generates the recovery value as a value proportional to an average of the sampled digital video data.

8. The organic light emitting display of claim 5, wherein the timing controller generates the recovery value as a value proportional to an average of the digital video data of each color calculated during the power-on period.

9. The organic light emitting display of claim 5, wherein the timing controller generates the recovery value as a value obtained by multiplying the data voltage or a change amount of characteristics of the driving element by a predetermined proportional constant.

10. The organic light emitting display of claim 9, wherein the predetermined proportional constant is proportional to the data voltage.

11. The organic light emitting display of claim 9, wherein the predetermined proportional constant is proportional to the power-on period.

12. The organic light emitting display of claim 9, wherein the recovery voltage is proportional to an amount of change in a threshold voltage of the driving element.

13. The organic light emitting display of claim 9, wherein the recovery voltage supplied to the pixels is held during a power-off period, wherein the predetermined proportional constant is inversely proportional to the power-off period.

14. An organic light emitting display comprising:

a display panel including data lines gate lines crossing the data lines, and pixels; and a panel driving circuit which supplies a data voltage to the pixels of the display panel during a power-on period and then is additionally driven for a predetermined power-on delay duration time delayed from a power-off start time of a power input signal, wherein the panel driving circuit supplies a reverse polarity recovery voltage having a polarity opposite the data voltage to the pixels or supplies a recovery voltage, which is different from a gate voltage of a driving element of each of the pixels, to a source terminal of the driving element of each pixel for the predetermined power-on, delay duration time wherein the panel driving circuit includes:

a data driving circuit configured to convert digital video data of an input image into the data voltage during the power-on period and supplies the data voltage to the data lines;

a gate driving circuit configured to sequentially supply gate signals to the gate lines during the power-on period and for the power-on delay duration time;

a reference voltage generator configured to supply a predetermined reference voltage to the source terminal of the driving element during the power-on period and cause the reference voltage supplied to the source terminal of the driving element to be greater than the gate voltage of the driving element for the power-on delay duration time; and a timing controller configured to transmit the digital video data of the input image to the data driving circuit during the power-on period, control an output voltage of the reference voltage generator using digital compensation data for the power-on delay duration time, and control operation timing of the data driving circuit and operation timing of the gate driving circuit.

15. The organic light emitting display of claim 14, wherein the timing controller generates the recovery value as a value proportional to an average of the digital video data during the power-on period.

16. The organic light emitting display of claim 14, wherein the timing controller samples the digital video data every predetermined period of time during the power-on period and generates the recovery value as a value proportional to an average of the sampled digital video data.

17. The organic light emitting display of claim 14, wherein the timing controller generates the recovery value as a value obtained by multiplying an average of the data voltage supplied to the pixels during the power-on period by a predetermined proportional constant.

18. The organic light emitting display of claim 14, wherein the timing controller generates the recovery value as a value obtained by multiplying a change amount of characteristics of the driving element during the power-on period by a predetermined proportional constant.

* * * * *